US010106961B2

(12) United States Patent
Rol Corredor et al.

(10) Patent No.: US 10,106,961 B2
(45) Date of Patent: Oct. 23, 2018

(54) RETENTION DEVICE FOR MALE AND FEMALE COMPONENTS IN EXCAVATOR MACHINES

(71) Applicant: METALOGENIA, S.A., Premia de Mar (Barcelona) (ES)

(72) Inventors: Javier Rol Corredor, St. Adria del Besos (ES); Javier Jimenez Garcia, Mataro (ES); Francisco Perez Soria, Premia de Mar (Barcelona) (ES); Jorge Triginer Boixeda, Barcelona (ES); Ester Alonso Frigola, Celra (Girona) (ES)

(73) Assignee: METALOGENIA PATENTES, S.L., Barcelona (ES)

( * ) Notice: Subject to any disclaimer, the term of this patent is extended or adjusted under 35 U.S.C. 154(b) by 0 days.

(21) Appl. No.: 15/342,235

(22) Filed: Nov. 3, 2016

(65) Prior Publication Data

US 2017/0051476 A1 Feb. 23, 2017

Related U.S. Application Data

(62) Division of application No. 14/130,831, filed as application No. PCT/ES2011/070488 on Jul. 5, 2011, now Pat. No. 9,512,599.

(51) Int. Cl.
*E02F 9/28* (2006.01)

(52) U.S. Cl.
CPC ..... *E02F 9/2841* (2013.01); *E02F 9/2833* (2013.01)

(58) Field of Classification Search
CPC ..... E02F 9/2833; E02F 9/2841; E02F 9/2858
USPC ..... 37/455, 456, 458, 459
See application file for complete search history.

(56) References Cited

U.S. PATENT DOCUMENTS

| | | | | |
|---|---|---|---|---|
| 1,212,868 A | | 1/1917 | Wohlford | |
| 2,092,311 A | * | 9/1937 | Hosmer | E02F 9/2825 172/777 |
| 3,223,452 A | | 12/1965 | Krekeler | |
| 3,359,662 A | * | 12/1967 | Petersen | E02F 9/2841 37/457 |

(Continued)

FOREIGN PATENT DOCUMENTS

| | | |
|---|---|---|
| DE | 2 404 751 A1 | 8/1974 |
| EP | 0 710 748 A1 | 5/1996 |

(Continued)

*Primary Examiner* — Gary S Hartmann
(74) *Attorney, Agent, or Firm* — Sughrue Mion, PLLC

(57) ABSTRACT

A retaining device, a retaining system between a female part and a male part, and a female part and male part to assure retention between a wear element or tooth and an adaptor element or tooth bar used in excavators and the like. The female part, which can be a wear element or tooth, or an adaptor element or tooth bar, has, auto-fixed thereto, a retaining device which participates in the coupling with a pin of the female part with a male part, and prevents the pin from coming out of its blocking position, maintaining the fixing between the two parts, i.e., male part and female part. The coupling between both parts is detachable, allows removing the pin from the coupling and replacing the female part or male part together with the retaining device. The retaining device is formed by one or more attached tightening elements.

4 Claims, 7 Drawing Sheets

(56) References Cited

U.S. PATENT DOCUMENTS

| | | | | | |
|---|---|---|---|---|---|
| 3,371,436 | A * | 3/1968 | Swanson | E02F 9/2841 37/459 |
| 3,400,476 | A | 9/1968 | Petersen | |
| 3,436,107 | A | 4/1969 | Karden | |
| 3,622,206 | A | 11/1971 | Krekeler | |
| 3,690,728 | A | 9/1972 | Krekeler | |
| 3,750,227 | A | 8/1973 | Hayhurst et al. | |
| 3,753,582 | A | 8/1973 | Graham | |
| 3,826,024 | A | 7/1974 | Petersen | |
| 3,832,077 | A | 8/1974 | Von Mehren | |
| 3,952,433 | A | 4/1976 | Heinold et al. | |
| 3,997,989 | A | 12/1976 | Stepe | |
| 4,050,172 | A | 9/1977 | Petersen | |
| 4,367,602 | A | 1/1983 | Petersen | |
| 4,404,760 | A * | 9/1983 | Hahn | E02F 9/2825 37/459 |
| 4,505,058 | A | 3/1985 | Peterson | |
| 5,177,886 | A * | 1/1993 | Klett | E02F 9/2825 37/452 |
| 5,556,224 | A | 9/1996 | Niskanen | |
| 7,210,540 | B2 * | 5/2007 | Ward | A01B 35/225 172/753 |
| 7,383,901 | B2 * | 6/2008 | Rayner | E02F 9/2816 175/413 |
| 9,512,598 | B2 * | 12/2016 | Rol Corredor | E02F 9/2841 |
| 9,512,599 | B2 * | 12/2016 | Rol Corredor | E02F 9/2841 |
| 2014/0133905 | A1 | 5/2014 | Rol Corredor et al. | |
| 2014/0186105 | A1 * | 7/2014 | Martinelli | E02F 3/58 403/320 |

FOREIGN PATENT DOCUMENTS

| | | | |
|---|---|---|---|
| EP | 0 835 963 | A1 | 4/1998 |
| WO | 93/05245 | A1 | 3/1993 |

* cited by examiner

RETENTION DEVICE FOR MALE AND FEMALE COMPONENTS IN EXCAVATOR MACHINES

This application is a division of application Ser. No. 14/130,831, filed Feb. 26, 2014, which is a National Stage of International Application No. PCT/ES2011/070488, filed on Jul. 5, 2011, the contents of all of which are incorporated herein by reference in their entirety.

OBJECT OF THE INVENTION

The present invention relates to a retaining device, a retaining system between a female part and a male part, as well as a female part and a male part to assure the retention between a wear element or tooth and an adaptor element or tooth bar used in excavators and the like. The female part, which can either be a wear element or tooth and either an adaptor element or tooth bar, comprises, auto-fixed or coupled thereto, a retaining device which participates in the coupling with a pin of the female part with a male part, and prevents along with said pin the latter from coming out of its blocking position, maintaining the fixing between the two parts, i.e., male part and female part. The retaining device can also be auto-fixed to the male part. The coupling between both parts is detachable as a result of the components of the retaining system, such that it allows removing the pin from the coupling and replacing the female part or male part together with the retaining device. Said retaining device is formed by one or more attached tightening elements. Likewise, the present invention relates to a male part and a female part comprising said retaining device coupled thereto, as well as to the retaining system made up of the female element, the male element, the pin and the retaining element.

The present invention especially applies to the sector of public works, such as excavations and mining.

BACKGROUND OF THE INVENTION

Excavators and the like, such as those used in public works and mining are used for pulling up, moving and loading earth and stones. These machines are usually provided with a shovel attached to a mechanical arm. The shovel is provided with a blade or beveled lip on a front edge intended for engaging and penetrating the mass of earth and stones. To prevent excessive wear of the blade and to aid penetrating the earth, it is common to assemble teeth associated with the blade projecting from the front edge thereof. However, said) teeth are also subjected to wear and breakages, so they must be frequently replaced, and furthermore, depending on the work that must be performed by the machine, it may be desirable to change the type or the shape of the teeth. To facilitate said replacement, tooth bar which are fixed to the blade of the shovel in a more or less permanent manner, and teeth are used, such that each tooth is releasably assembled in the tooth bar by means of a pin. Said pin usually traverses the orifices of the tooth and a duct traversing the tooth bar for the purpose of fixing the tooth to the tooth bar, thus assuring the connection between them using a retaining device for fixing said pin in its assembly position preventing the pin from coming out of its position when the machine is working and the tooth/tooth bar/pin system receives large stresses.

When the tooth and tooth bar assemblies work in difficult conditions, the pin attaching them tends to trove against the force for thrusting a retaining device which abort with the pin keep the tooth and the tooth bar attached. Then, the pin can come out of the tooth bar both the pin and the tooth may be lost. The loss of a tooth and/or pin may be very important depending on the work site thereof, possibly causing breakdowns in other machines, such as stone crushers, working in the same production site as the machine using the teeth, such as mines or quarries for example. As mentioned, a retaining device associated with the pin is used to prevent the pin from coming out of its assembly position between the tooth and the tooth bar, fixing the pin in its said assembly position. The retaining systems, comprising at least one pin and at least one retaining device, tend to have elastic features, provided to the retaining systems by the retaining device, so that the pin can be fixed and freed without requiring to break it while at the same time allowing its introduction into and extraction from the system in a simple, preferably hammerless manner, i.e., without needing a hammer.

Usually retaining devices made of elastic material such as rubber or polyurethane are used since it has elastic features which allow an easy to disassemble system, without applying excessive forces. These retaining devices are not useful for every type of works due to the fact that in applications where the temperature of the material moved, excavated or pulled up is high, the elastic material used can melt and/or lose its elastic qualities leaving the pin without retention, which could also cause a loss of the pin and/or of the tooth.

U.S. Pat. No. 3,952,433 describes a pin retaining system. The pin is introduced into aligned bores formed by the tooth and the tooth bar and the retaining device is provided with a clip in the form of a spring straddling the pin on both sides fixing it to its assembly position. Said clip is encapsulated in an elastomer element for the purpose of keeping said retaining element in its position.

Encapsulating the retaining system in an elastomeric element makes the retaining system useless in tasks where the working temperature is very high since the properties of the elastomer material are lost increasing the possibilities of losing the pin. Furthermore, the use of an elastomeric element causes interference problems between elements since it has an uncontrolled deformation by pressure. Another feature of this retaining system is that the use of a clip in combination with an elastomeric material, and the positioning of the assembly in the adaptor element, means that the force needed to be used for assembling and disassembling the pin is high, the use of a hammer being necessary and making it incompatible for hammerless systems.

The retaining system described in the U.S. Pat. No. 3,997,989 comprises a pin of variable sections and a retaining system provided with two spring's located in a washer shaped elastic element. The two springs of the retaining system have a straight area and a curved area of different section. Said washer with the two springs is positioned in a cavity in the adaptor element, then the tooth is assembled and then the pin, such that the section thereof causes the straight area of the springs to open being compressed until reaching notches located in the pin, and when the notches of the pin find the straight areas of the springs the latter are fixed in the notches preventing the pin from coming out. Like the U.S. Pat. No. 3,952,433, the use of an elastic material prevents this system from being used in works where the temperature is very high. Furthermore, the force needed for assembling and disassembling is high preventing its use in hammerless systems. Another drawback of this invention is that the retaining device, or washer, is located in a cavity which does not secure its position except at the time of coupling between the tooth and tooth bar.

DESCRIPTION OF THE INVENTION

For the purpose of overcoming the mentioned drawbacks as well as simplifying the assembly and disassembly of a wear element, or tooth, in an adaptor element, or tooth bar, specifically of the type provided with a retaining device suitable for all type of works, including those requiring high temperatures, and the coupling being performed between both elements by means of a pin which is housed in a duct formed between the tooth and the tooth bar for thus securing the wear element or tooth in the adaptor element or tooth bar, a first object of the present invention is a retaining device or retainer device according to claim 1.

A second object of the present invention is a female part, wear element or tooth, according to the content of claim 14.

A third object of the invention is a male part, adaptor element or tooth bar according to claim 19.

An additional object of the present invention is a retaining system between a female part and a male part for excavators and the like, according to claim 24.

The retaining device is made up of at least one tightening element, preferably formed by an elongated body made of a material with elastic properties, preferably with circular section, also being able to be square or rectangular, and having a configuration which allows the auto-fixing of same by pressure directly to a surface of a female part or of a male part. In a mate part said retaining device is auto-fixed to the outer surface and in a female part it is auto-fixed to an inner surface. Said retaining device, coinciding with the tightening element when said device comprises a single tightening element is preferably U-shaped in its auto-fixing position with two parallel straight sectors attached by a third sector.

As mentioned, in auto fixing position in a female part or in a male part, the two straight sectors of the tightening element are parallel as they adapt to either the inner or outer surfaces of the female part or male part, respectively, said surfaces being slightly parallel to one another. Said tightening element has two straight sectors attached to one another at one of their ends by a third sector and the opposite end of each straight sector being free, such that it is also almost U-shaped, even without having been auto-fixed to the female part or to the male part. The distance between the free ends of the straight sectors is different from the distance between the ends for the attachment to the third sector, therefore the distance between the free ends can be greater or less than the distance between the ends for the attachment to the third sector. When the distance between the free ends is greater than the distance between the ends for the attachment to the third sector, the tightening element is used to be auto-fixed to a female part, specifically to the cavity of said female part. On the other hand, when the distance between the free ends is less than the distance between the ends for the attachment to the third sector the tightening element is suitable to be auto-fixed to a male part. The above requires the existence of inclination between the two straight sectors and the third sector, the angle formed by the two straight sectors with the horizontal of the third sector being able to vary preferably between 1 and 5 degrees, hence the appearance of the tightening element is almost U-shaped, because the inclination is small. However, said inclination can be adapted to the different circumstances and situations as required being able to be greater than that indicated.

The tightening element is preferably a steel wire with circular section, although it can also be Teflon or a plastic material, the sections also being able to be square or rectangular.

According to the above, the female part object of the present invention, comprising a retaining device, is a wear element or tooth of the type formed by upper and lower outer surfaces diverging to a leading edge and two outer surfaces, and comprises an internal cavity with inner surfaces, having the function of receiving a protrusion or nose of a male part or adaptor element. The two side outer surfaces form with said cavity respective walls being provided with at least one through hole in one of said walls and traversing same to allow the entry of a pin when the wear element is coupled to the adaptor element. Each of the side walls preferably has an opening or through hole. The inner surfaces of the side walls coincide with the surface of the cavity of the female part. Said female part comprises a retaining device formed by at least one tightening element which is an elongated body made of a material with elastic properties, which is auto-fixed to the inner surfaces of the walls and/or the internal cavity, and which is located such that it interferes with the at least one hole or orifice located in the wall of the female element.

The male part object of the invention comprises a nose to be introduced into the cavity of a female part, said nose being traversed by a duct intended for housing a pin during the coupling of the male part to a female part, and said nose having a retaining device comprising at least one tightening element formed by an elongated body and made of a material with elastic properties, which is auto-fixed directly by pressure against the outer surfaces of said nose such that said retaining device interferes with at least one of the entry orifices for the entry of the pin into the duct. The nose is preferably completely traversed creating a duct with two access orifices and in which the pin will be housed by passing through once the female part and the male part are coupled to one another. On occasions the duct does not traverse the entire nose, i.e., said duct does not need to be a through duct.

The retaining system according to the invention comprises a female element or tooth, a male element or tooth bar, a pin preferably formed by a body of revolution, and provided with at least one notch at at least one of its ends and a retaining device formed by at least one tightening element, preferably formed by an elongated body made of a material with elastic properties, such that the retaining device is auto-fixed with tension and in direct contact against one of the two parts, such that the rotation of the pin allows the coupling between both parts to go from a retaining position in which the retaining device is fitted in the notch of the pin preventing both parts from separating, to a release position in which the device comes out of said at least one notch thus allowing both parts to be separated. To facilitate the rotation of the pin when it is retaining the male part and the female part with one another, the surface adjacent to the introduction orifice for introducing the pin comprises two inclination ramps opposite one another and concentric to said orifice. These ramps allow the rotation of the pin in both directions when it has to be extracted.

According to the above, the main components of the system are therefore:

- A pin made up of a preferably frustoconical body of revolution, although other configurations, such as cylindrical for example, are possible. Said pin this provided with at least one notch in at least one of its ends. Said pin is also provided with a cavity in one of the bases of the body for introducing a tool which allows the rotation of the pin for assembling and disassembling. The pin can have between one and four notches, the notches being located from one per end to two notches per end.

A retaining device formed by at least one tightening element which is auto-fixed by pressure to the internal surface of the cavity of a female part or to the external surface of the nose of a male part due to its U-shaped configuration crossing at least one of the orifices arranged in the male part or female part in which the pin will be introduced, and which is preferably located in a groove arranged on the surface, either of the cavity or of the nose. This retaining device in any of its variants has the shape of the cavity or of the nose. Said retaining device can be located either on one side of the part, on the opposite side or on both, but always crossing at least one orifice through which the pin will be introduced.

A male part and a female part intended for being coupled to one another, such that one of the two incorporates, fixed to its surface, the mentioned retaining device for assuring the coupling between both parts when said retaining device interacts with the pin traversing the assembly formed by the female part and the male part through the orifices and duct made in both parts. That part to which the retaining device is auto-fixed preferably has a groove traversing or crossing said orifices, interfering with them. The width of the groove in the area crossing the hole is slightly less than the diameter of the opening.

As mentioned, the retaining device is auto-fixed, due to its configuration and elastic properties, directly to a surface of a female part or male part. Auto-fixing is understood as the fact that the retaining device is capable of being fixed to the surface without needing any other additional component or element, only and exclusively due to the geometric configuration of the tightening element or elements, with elongated bodies, forming the retaining device and to the elastic properties of the material in which it is manufactured. The fact that the device is auto-fixed directly to a surface means that the device is in direct contact with said surface, i.e., there is no intermediate element or component between the device and the surface. Evidently, in order to facilitate said fixing, it is possible to include constructions in the parts, or elements in the device itself, facilitating or collaborating with said auto-fixing. An example of the above are the grooves made on the surfaces of the female part or of the male part. Likewise, it is possible to use, at the ends of the retaining device, elements fixed to said ends with non-slip properties.

In the event that the surface of the female part or of the male part has a groove to receive the retaining device, it is located in said groove, particularly, at least one straight sector of the retaining device is located in the sector of the groove traversing the orifice of the part for introducing the pin. Since the groove of the part has a width less than the diameter of the orifice, the straight sector of the retaining device interferes, i.e., traverses or crosses, the orifice of the part thus hindering the entry of the pin.

The retaining device made up of at least one U-shaped tightening element, has as mentioned at least two straight sectors with an additional sector attaching both straight sectors, and one of said straight sectors can additionally have a split or bifurcation such that it determines a sector with two straight sub-sectors approximately parallel to one another. Said bifurcation can be on the two straight sides of the retaining device in this event, the distance between the two parallel straight sub-sectors is less than the diameter of the orifice thus interfering with same and the entry of the pin. The retaining device can comprise a single tightening element or two tightening elements attached to one another to achieve the geometries described above. The section of the tightening element varies depending on the dimension of the coupling formed by the tooth and tooth bar, i.e., depending on the size and weight of the coupling. Usually, in the case of using a steel wire, the diameter thereof will vary between 1 mm and 5 mm, not dismissing the fact that it could be greater. The section of the tightening element must be such that it allows assuring the expansion of the element when the pin is introduced and that it returns to its original situation, without breaking, i.e., a suitable elasticity-resistance ratio must be reached preventing large sections that prevent the expansion of the tightening element.

Furthermore, as described above, and according to the geometry of the retaining device itself, and to facilitate the auto-fixing thereof to the part, and due to the fact that in some configurations of the retaining device the distance between the free ends of the straight sectors of the tightening element is slightly greater than the distance between the internal surfaces of the internal cavity of the female part or slightly less than the distance between the outer surfaces of the nose of the male part, thus allowing auto-fixing the retaining device in the groove which runs along the surfaces of the cavity or of the nose, where appropriate. For said auto-fixing, there is required a small compression to introduce the retaining device into the groove of the cavity and a small expansion to introduce it into the groove of the nose, such that when the pressure ceases the retaining device tends to open or close tightening against the groove by spring effect.

In a first configuration, the U-shaped retaining device has a tightening element with an extension of the straight sectors, in this case parallel, through their tree ends such that said ends are bent twice approximately 90°, becoming hook-shaped, such that it allows to be fixed by said ends and by pressure to the wall of a female part, said ends of the device being outside the part, i.e., outside the wall, and the two parallel straight sectors attached by the third sector, located inside the cavity. In this configuration, the separation between the free ends of the two parallel straight sectors is less than the diameter of the entry orifice for the entry of the pin. The female part, where this retaining device is incorporated, preferably has a groove to house the device the width of which is less than the diameter of the orifice.

In a second configuration, the free ends of the straight sectors of the tightening element are separated from one another by a distance similar to the distance separating the inner surfaces of the walls of the female part or to the distance separating the outer surfaces of the male part. This distance will be slightly greater in the event of using the device in a female part and slightly less when it is used in a male part. In the event of a female part, the groove in the internal cavity starts its run crossing the orifice located in the wall of the female part, reaching the bottom of the cavity and crossing said bottom or front internal wall until reaching the second side wall of said internal cavity opposite the first one. If there is a second orifice in the wall opposite the previous one, the groove can also cross said orifice. The retaining device of this configuration works with the same mechanism as the previous one, because the distance between the free ends of the straight sectors of the retaining device is slightly greater than the distance between the sides of the internal cavity of the female part, which in order to locate the retaining device in the groove requires a small compression to introduce said device into the groove such that when the pros sure ceases the retaining device tends to open tightening against the surface of the cavity in the groove by spring effect due to its elastic properties. The complementary form would be applicable to a retaining device in a male part.

An alternative to the above configuration consists of the fact that one of or both the straight sectors of the above retaining device has a split or bifurcation such that each straight sector has two almost U-shaped straight sub-sectors parallel to one another. This configuration can be formed by a tightening element or by two tightening elements attached to one another. In this case, the parallel straight sub-sectors interfere with the hole arranged on the wall of the female part or in the nose of the male part. Its assembly both in the female part and in the male part is similar to that described above.

For the coupling between the female part and the male part, when the retaining device is auto-fixed to the cavity of the female part or to the nose of the male part according to any of the alternatives mentioned above, the cavity of the female part slides in the nose of the male part, aligning the at least one orifice of the female part with the duct traversing the nose of said male part at least partially. Once aligned, the pin is introduced through the orifice of the female part such that said pin faces at least one straight sector of the retaining device hindering the entry of the pin. This straight sector of the retaining device tends to open by the pressure exerted by the pin, such that it forces the sector of the device to expand to allow the passage of the pin until the sector of the retaining device faces the notch of the pin and is housed therein releasing the retaining device of the tension exerted by the pin during its introduction, and the retainer device is thus relaxed and in work situation. In this situation the female part and the male part are coupled and retained to one another. As mentioned, there can be two orifices in the female part with which two sectors of the retaining device interfere and which can also be housed in two notches arranged at the two ends of the pin. Said female part can be a tooth or a tooth bar and the male part will be complementary to the aforementioned, i.e., a tooth bar or a tooth.

The assembly in the alternative case of arranging the retaining device in the male part follows the same principles as the described assembly.

To extract the pin and thus be able to separate the female part from the male part, a tool adapted to the base of the pin is introduced and the pin is forced to rotate for at least 90°, such that the at least one notch of the pin also rotates and causes the least one straight sector the retaining device to move and come out of the notch of the pin, therefore the pin can be removed from the assembly between the male part and the female part. In the event that the straight sector of the device has two parallel straight sub-sectors, the rotation of the pin causes both sub sectors to separate and come out of their housing in the notches of the pin, thus releasing the in and allowing the separation of the male part and the female part.

It should be highlighted that the pin, and therefore the aligned orifices and ducts of the female part and of the male part can be located in vertical position or in horizontal position.

The advantage that the retaining device is auto-fixed to the female part or to the male part allows delivering female parts and male parts with the retaining devices incorporated therein from the factory.

As a result of these features, the coupling between the female part and the male part as well as the disassembling operation are performed in a simple manner without needing to apply strong blows on the pin which can be dangerous, while at the same time providing solid and reliable coupling while working. In addition to its constructive features, this is possible because the dirt to which the device is subjected to when working does not affect the operation thereof, due to the tact that the dirt does not interfere in the movement of the retaining device.

To facilitate disassembling the pin, it preferably has section in the form of d wedge such that it is easily released from the channel coming out of the interference with the wear device.

The ease of assembling and disassembling the wear elements without needing excessive forces, allows assembling a greater number of wear elements in the bucket of the machine without needing to go to the workshop, i.e., this task can be performed in the field.

One feature of the present retaining device is that it can be adapted to the already existing coupling systems between a male part and a female part.

BRIEF DESCRIPTION OF THE DRAWINGS

To better understand what has been described, drawings in which several practical embodiments are depicted schematically and only by way of non-limiting example are attached.

DESCRIPTION OF PREFERRED EMBODIMENTS

In view of the mentioned drawings different preferred embodiments of the different objects of the invention are described.

Figure 1:
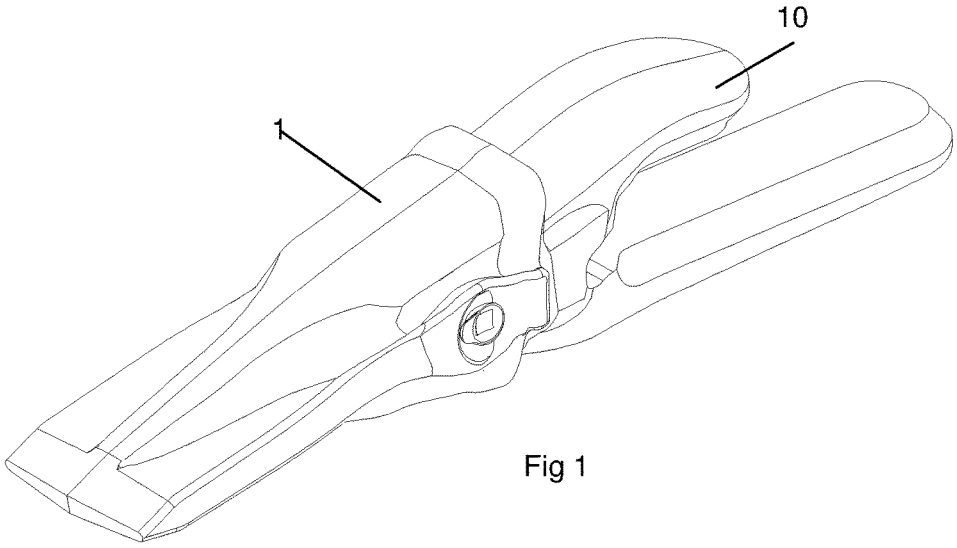
FIG. 1 shows a perspective view of a coupling between a female part and a male part, particularly a tooth and a tooth bar.
Figure 2:
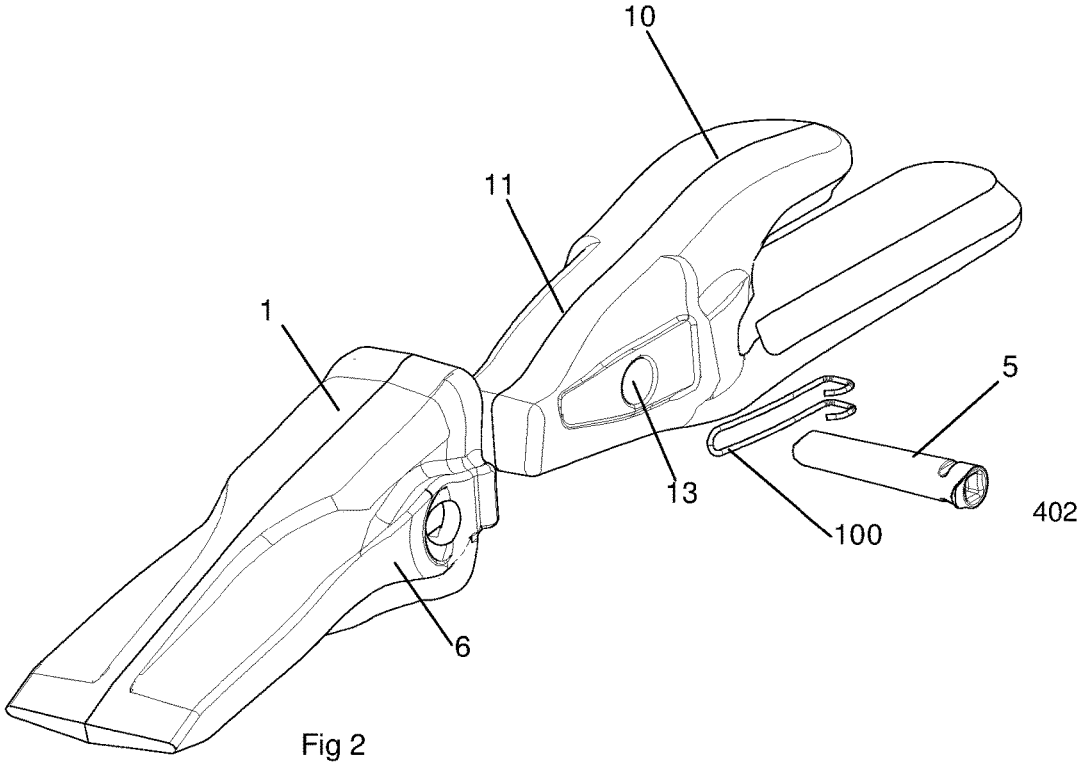
FIG. 2 shows an exploded view of FIG. 1.
Figure 3:
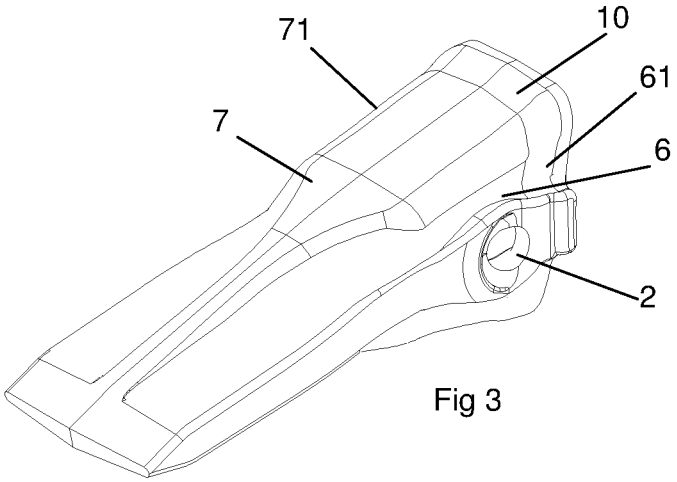
FIG. 3 shows a perspective view of a female part, particularly a tooth.
Figure 4:
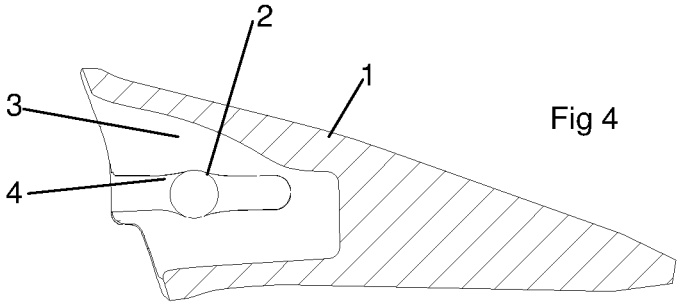
FIG. 4 shows a cross-section of FIG. 3.
Figure 5:
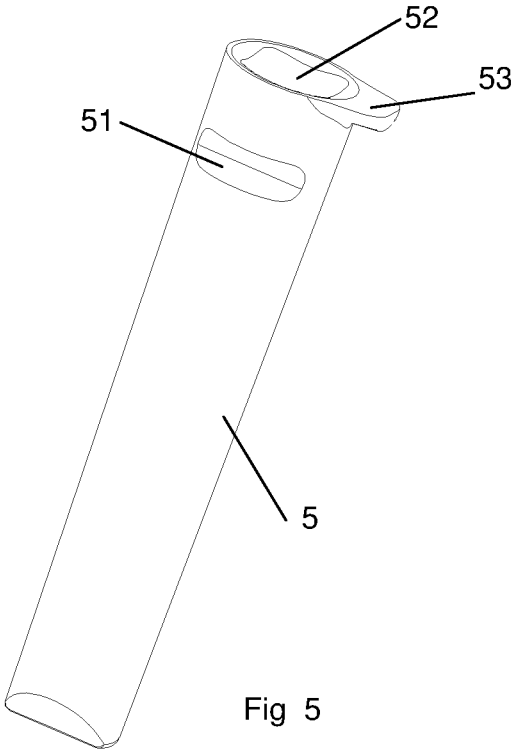
FIG. 5 shows a perspective view of a pin.
Figure 6:
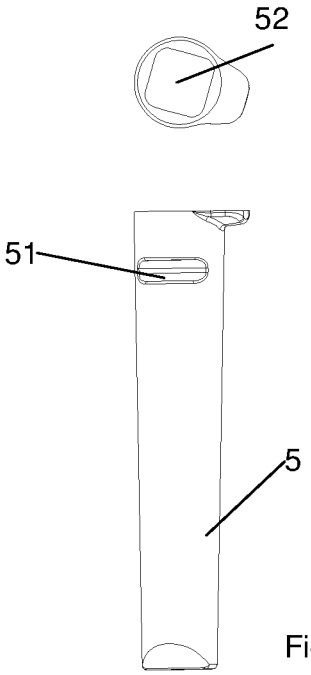
FIG. 6 shows a plan view and an elevational view of the pin of FIG. 5.
Figure 7:
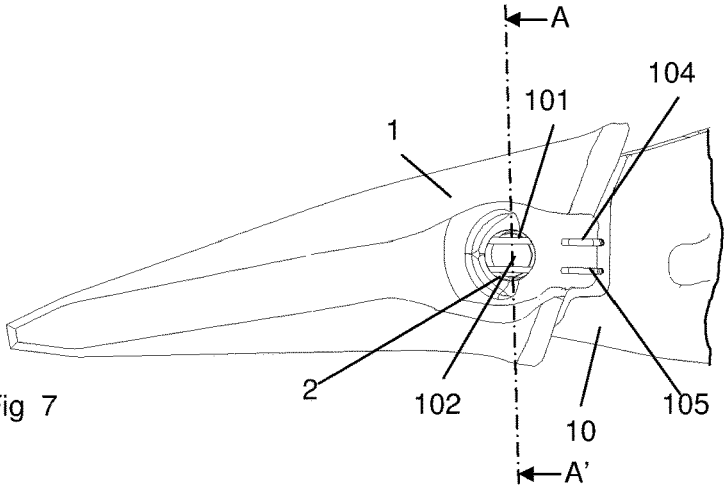
FIG. 7 shows a side view of a coupling between a tooth and a tooth bar with a retaining device according to a first preferred embodiment.
Figure 8:
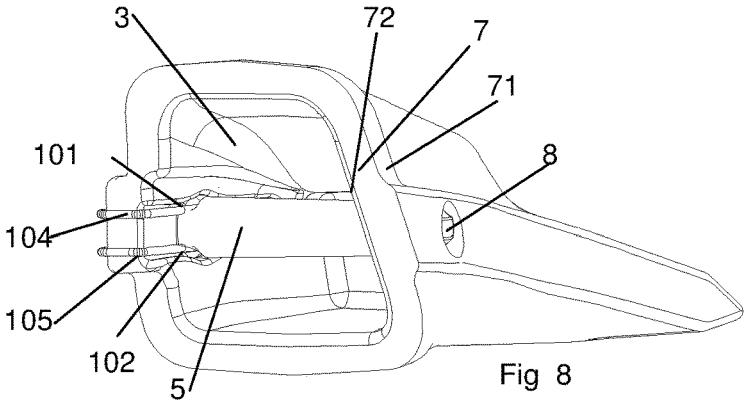
FIG. 8 shows a rear perspective view of a tooth with a pin and a retaining device according to a first preferred embodiment.
Figure 9:
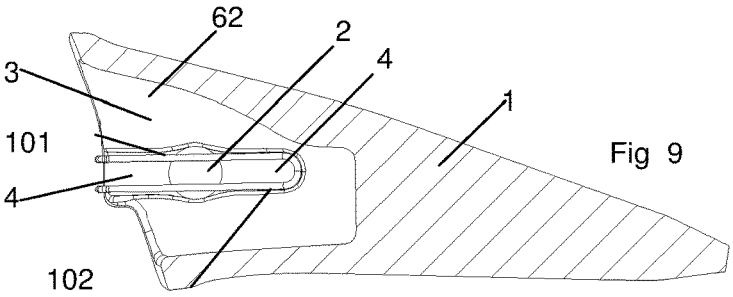
FIG. 9 shows a cross-section of FIG. 8.

FIGS. 1 to 20 show a female part (1) acting as a tooth coupled to a male part or tool bar (10). FIGS. 1 and 2 show an outer view of the tooth (1) coupled to the tooth bar (10). The tooth or female part (1) has at least two side walls (6, 7) having an outer surface (61, 71) and an inner surface (62, 72). Said inner surfaces (62, 72) coincide with a cavity (3) intended for housing the male part or tooth bar (10) and particularly a nose (11) of said tooth bar (10). At least one of the side walls has an orifice (2, 8) connecting the outer surface (61, 71) of the wall with the inner surface (62, 72) and therefore with the cavity (83) of the tooth. Preferably, and as shown in the drawings, the tooth has two orifices (2, 8), one in each of the opposite walls (6, 7). The tooth bar (10) in turn has a duct (13) which traverses the nose and which, when housed in the cavity (3) of the tooth (1), is aligned with the orifices (2, 8) of the walls of the tooth (1). To assure the position a pin with a body of rotation completely traversing both the tooth and the tooth bar is introduced through the mentioned orifices (2, 8) and duct (13). A retaining device (100, 200, 300, 400) which contributes to maintain said coupling and which is the object of the application is used to assure the position of the pin (5) and maintain the coupling between the tooth (1) and the tooth bar (10). Said retaining device (100, 200, 300, 400) works together with the pin (5). The pin (5) has a body of rotation, preferably with a slight taper to facilitate its insertion into and extraction from the coupling between the tooth and the tooth bar, and has a notch (51) interacting with the retaining device on the surface of at least one of its ends. The pin can incorporate said notch (51) at any of its two ends or at both ends, being able to incorporate one or two notches at each end. Likewise, it incorporates in at least one of its bases, preferably in the larger one in the event that the body has a certain taper, a housing or slot (52) for introducing a tool which allows rotating the pin (5). The pin also has a protrusion (53) in said base preventing the complete introduction of the pin into the orifice (2, 8) and duct (13) of the coupling between the tooth and the tooth bar, and it in turn serves to guide the rotation of the pin (5) during the extraction thereof by sliding on one of the two ramps (91, 92) arranged on the surfaces adjacent to the entry orifice (2, 8) for the entry of the pin (5) into the tooth (1). Said ramps (91, 92) allow the pin (5) to rotate in any of the two directions for extraction thereof.

Each of the different preferred constructions of the retaining device object of the present invention will be described below.

Figure 10:
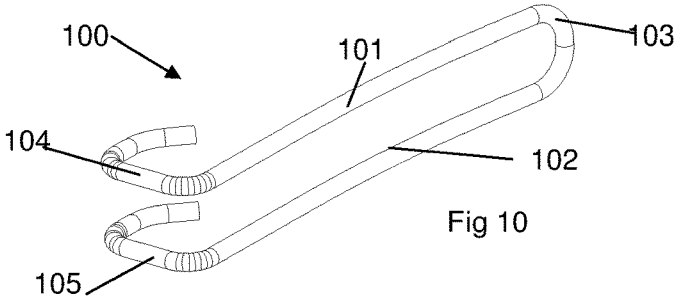
FIG. 10 shows a perspective view of a retaining device according to a first preferred embodiment.
Figure 11:
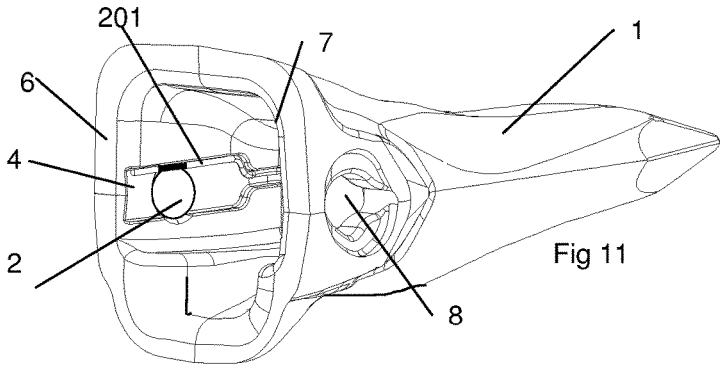
FIG. 11 shows a rear perspective view of a tooth with a retaining device according to a second preferred embodiment.
Figure 12:
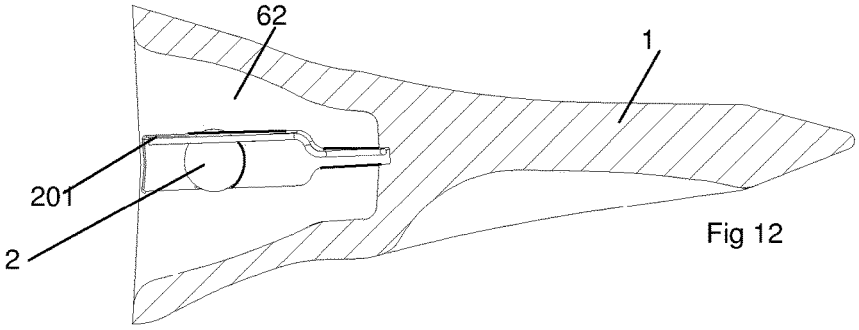
FIG. 12 shows a cross-section of FIG. 11.
Figure 14:
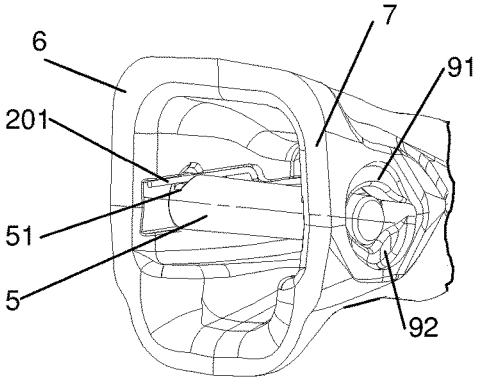
FIG. 14 shows a rear perspective view of a tooth with a pin and a retaining device according to a second preferred embodiment.

FIGS. 7 to 10 and 20 show a construction and use of a first embodiment of a retaining device. In particular, FIG. 10 shows a retaining device (100) comprising a tightening element, an elongated body with elastic properties, preferably made of steel with circular section. The device (100) is U-shaped with two parallel sectors (101, 102) or almost parallel sectors, attached to one another at one of their ends by a third sector (103), which in this case is curved. On the end opposite the end for attachment of both parallel sectors (101, 102) the latter extend through their free ends (104, 105) and are each bent twice 90°, becoming hook-shape.

This hook-shape is used to auto-fix the retaining device in direct contact with the surface of the tooth (1), and the retaining device is particularly fixed by its free ends (104, 105) to the wall (6) of the tooth (1), such that said ends (104, 105) of the retaining device (100) are located on the outer surface (61) of the wall (6), and the parallel sectors (101, 102) are located in the cavity (3) of the tooth (1). Both parallel sectors (101, 102) are separated from one another by a distance less than the diameter of the orifice (2) existing in the wall in which the retaining device is fixed, such that both sectors (101, 102) interfere with said orifice (2). The length of the retaining device (100) is sufficient to allow fixing the device to the wall (6) and interfering with the orifice (2).

Additionally, and to complement the of the retaining device (100) to the tooth (1), it has a groove (4) on the inner surface (62) of the wall (6) extending into the cavity (3), the width of said groove (4) being less than the diameter of the orifice (2). Said groove (4) crosses the orifice (2) and allows introducing the retaining device (100) therein, to that end slightly compressing the retaining device (100) being necessary, since the distance between the straight sectors (101 and 102) is slightly greater than the width of the groove (4).

The cavity of the tooth (3) is slid into the nose of the tooth bar (10) to couple the tooth (1) to the tooth bar (10) after having auto-fixed the retaining device (100) in the tooth (1) as mentioned above. The retaining device (100) sits between the surfaces (111, 112) of the nose (11) and the surfaces (62, 72) of the cavity (3) when the nose (11) is coupled to the cavity (3). Once the tooth (1) and the tooth bar (10) are coupled, with the retaining device (100) interfering with the orifice (2) of the tooth (1) and located between said orifice (2) and the entry orifice for entry into the duct (13) of the nose (1) of the tooth bar (10), the pin (5) is introduced through the orifice (2) of the tooth, which causes the separation of both parallel sectors (101, 102) of the retaining device and allows the introduction of pin (5) until at least one of said parallel sectors (101, 102) meets the at least one notch (51) made on the surface of the pin (5) being housed therein, being located in a retaining position in which the coupling between the tooth (1) and the tooth bar (10) is tight by preventing both parts from separating. A cross-section of the coupling in which two notches (51) made on the surface of the pin (5) can be observed in FIG. 20, such that each of the parallel sectors (101, 102) are housed in each of the notches (51).

It will be sufficed to rotate the pin (5) with a tool introduced into the slot or housing (52) arranged in the base of the pin (5) to achieve a release situation in which due to the rotation of the pin the parallel sectors (101, 102) come out of said notch or notches (51) as the sectors (101, 102) separate due to the fact that the section of the pin (5) increases and thus allowing the extraction of said pin (5) and therefore the separation of the tooth (1) and the tooth bar (10). The section of the pin (5) increases with the rotation of the pin (5) about its shaft because the distance between the surface of the notch and its opposite surface is less than the distance between the surfaces of revolution of the pin (5), this section variation causing an increase in the separation of the straight sectors (101, 102) upon rotating the pin (5) with respect to the fixed position of the retaining device.

The above action is usually performed when replacement is required, either because the tooth is worn after use or because another tooth design is required. To facilitate the rotation of the pin (5) when the latter is retaining the tooth has (10) and the tooth (1) to one another, the surface adjacent to the introduction orifice for introducing the pin (5) comprises two inclination ramps (91, 92) opposite to one another and concentric to said orifice (5). These ramps (91, 92) allow rotating the pin in both directions when it must be removed, the stop arranged at one end of the pin (53) being slid on the mentioned ramps (91, 92).

Figure 13:
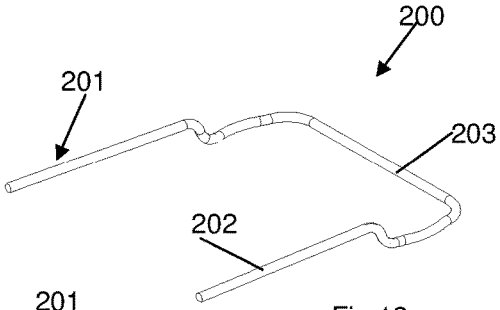
FIG. 13 shows a perspective view of a retaining device according to a second preferred embodiment.
Figure 15:
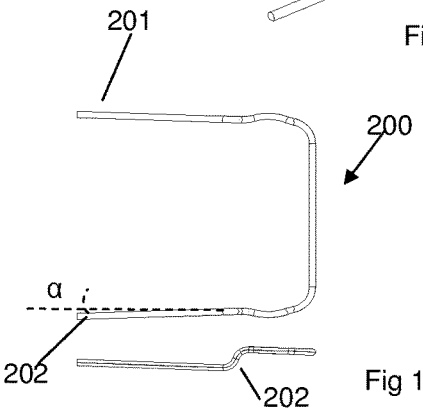
FIG. 15 shows an elevational view and a plan view of FIG. 13.

FIGS. 11 to 15 show a second preferred embodiment of a device (200) object of the present invention. FIGS. 13 and 15 show said retaining device (200) which comprises a tightening element, an elongated body with elastic properties, preferably made of steel and with circular section.

The device (200) is almost U-shaped with two straight sectors (201, 202) attached to one another at one of their ends by a third sector (203), there being an inclination of approximately 2° (α) between at least one straight sector and the third sector. The straight sectors (201, 202) can have a small inclination variation. The auto-fixing of this retaining device (200) is achieved by introducing it into the cavity (3) of the tooth (1) for which it is necessary to bring the two free ends of the straight sectors (201, 202) closer to one another, compressing them so they auto-fix by pressure against the inner surfaces of the cavity upon releasing the two straight sectors. Likewise, the length of the third sector (203), i.e., the separation of the two straight sectors (201, 202) by one of its ends is at least equal to the distance separating the inner surfaces (62, 72) of the walls (6, 7) of the tooth (1), while the distance between the two free ends of said straight sectors is greater than the distance separating the inner surfaces (62, 72) of the walls (6, 7) of the tooth (1). This causes the two straight sectors (201, 202) to directly press the inner walls of the cavity (3) and assure the auto-fixing of the retaining device (200).

Additionally and to complement the auto-fixing of the retaining device (200) to the cavity (3) of the tooth (1), it has a groove (4) on the inner surfaces (62, 72) of the walls (6, 7) extending into the cavity (3), being able to reach the bottom thereof, and the width of said groove (4) being less than the diameter of the orifice (2). Said groove (4) crosses the orifice (2) and allows introducing the retaining device (200) therein.

The assembly and disassembly of the coupling between the tooth and the tooth bar in combination with this second retaining device (200) is identical to that explained above.

Figure 16:
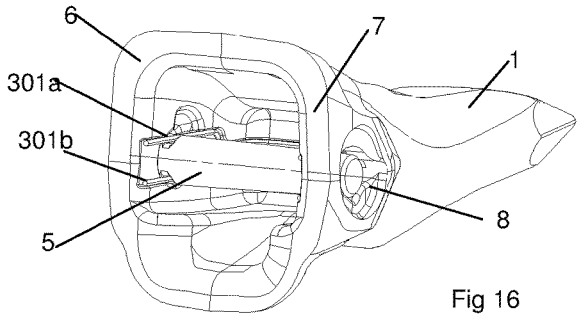
FIG. 16 shows a rear perspective view of a tooth with a pin and a retaining device according to a third or fourth preferred embodiment.
Figure 17:
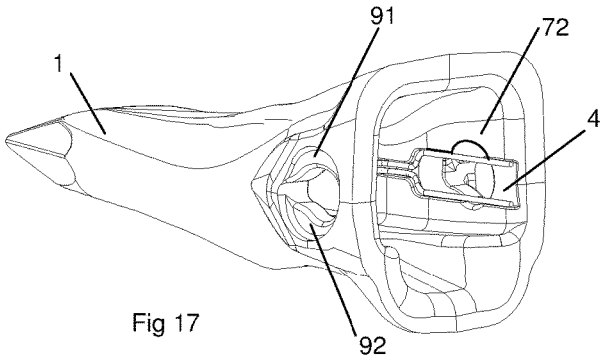
FIG. 17 shows a rear perspective view of a tooth with a retaining device according to a third or fourth preferred embodiment.
Figure 18:
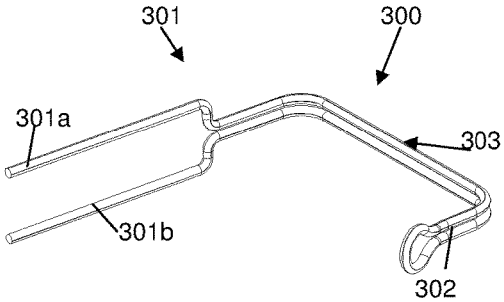
FIG. 18 shows a perspective view of a retaining device according to a third preferred embodiment.
Figure 19:
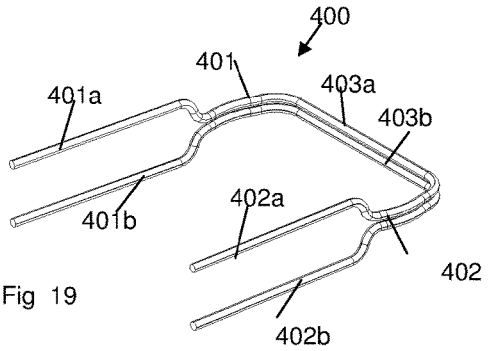
FIG. 19 shows a perspective view of a retaining device according to a fourth preferred embodiment.
Figure 20:
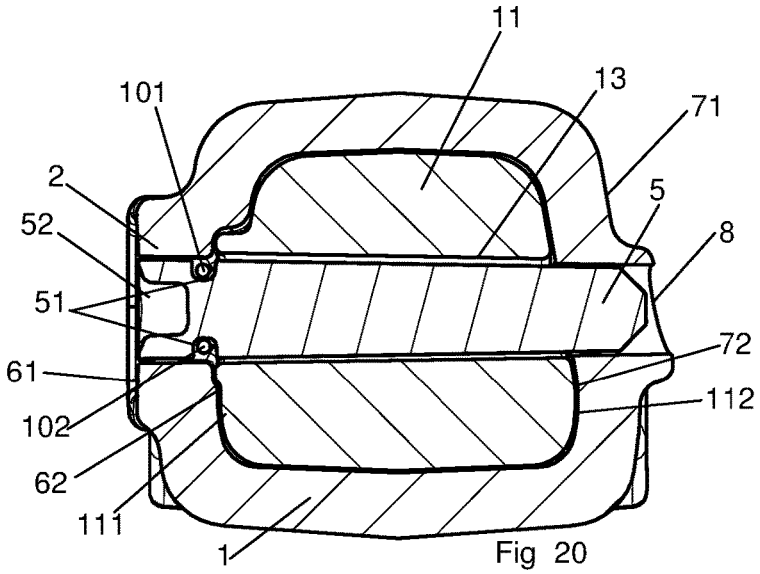
FIG. 20 shows a cross-section AA of FIG. 7.

A third embodiment of a retaining device (300) is shown in FIG. 13 in combination with FIGS. 16 and 17, which can also be used to explain the fourth embodiment of a retaining device (40).

The third embodiment of the retaining device (300) comprises a tightening element, an elongated body with elastic properties, preferably made of steel and with a circular section.

This third retaining device (300) is almost U-shaped with two straight sectors (301, 302;) attached to one another by a third sector (303) almost perpendicular to both straight sectors. One of the straight sectors is longer than the other, said longer sector (301) having a split or bifurcation thus determining a sector (301) with two straight sub sectors (301*a*, 301*b*) approximately parallel to one another. Said two sub-sectors (301*a*, 301*b*) are separated from one another by a distance less than the diameter of the orifice (2, 8) of the tooth (1), such that both sub-sectors (301*a*, 301*b*) interfere with said orifice (2, 8).

This retaining device (300) is auto-fixed to the tooth (1) in a manner similar to toe second retaining device (200). The tooth in this case can also include a groove (4) for housing said retaining device (300).

An alternative of the above retaining device (300) is the fourth retaining device (400) comprising a straight sector of equal length to the first (401, 402) in the shortest straight sector (302). In this retaining device (400) both straight sectors (401, 402) have a split or bifurcation thus determining two sectors (401, 402) with two straight sub-sectors (401*a*, 401*b*, 402*a*, 402*b*) almost parallel to one another.

Both the arrangement of the tooth and the operation of the retaining device in the coupling between the tooth and the tooth bar are identical to those detailed above.

Figure 21:
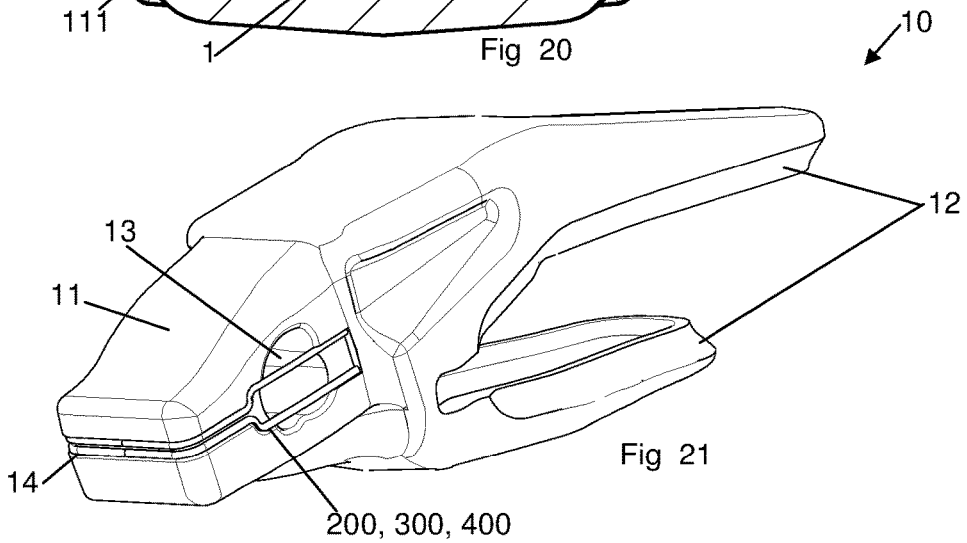
FIG. 21 shows a perspective view of a tooth bar with a retaining device.
Figure 22:
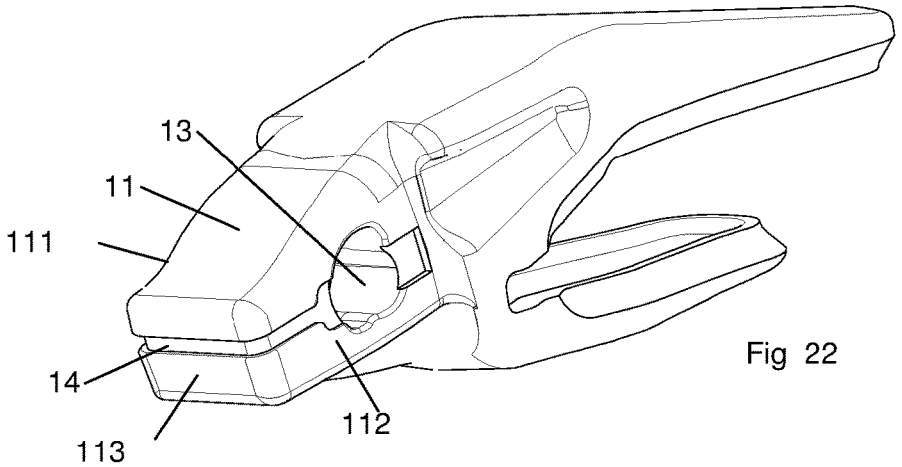
FIG. 22 shows the tooth bar of FIG. 21 without the retaining device.

As mentioned above, it is also possible to locate the retaining device (200, 300, 400) in a tooth bar (10), auto-fixed to the outer surfaces of the tooth bar, as shown in FIGS. 21 and 22. Said tooth bar (10) comprises a nose or protrusion (11) in its top part and securing means (12) for securing to the shovel of the bucket in its rear part. The constitution of the retaining device (200, 300, 400) would be similar to those described above, with the difference that instead of having to compress them to be inserted into the cavity of the tooth these should be slightly open to be fitted to the outside or the nose (11) of the tooth bar (10) exerting pressure on said side outer surfaces (111, 112) of the nose (11) of the tooth bars (10). In this alternative construction, the retaining device (200, 300, 400) also crosses the entry orifice for entry into the duct (13) traversing the nose (11), said retaining device (200, 300, 400) being located in groove (104) made on the outer surfaces (111, 112, 113) of the nose (11) of the tooth (10). Said grooves are preferably made at least on the side surfaces or opposite surfaces (111, 112) of the nose (11), crossing the entry orifices for entry into the duct (13) and more preferably also on the front surface or tip. (113) of said nose (1).

It must be taken account that in the present description a tooth has been considered as a female part and a tooth bar as a male part, but it is possible to have a tooth as a male part and that it has a nose with a retaining device auto-fixed therein, as well as a tooth bar as a female part, having a cavity with a retaining device auto-fixed therein. In other words, a female part is that which has a cavity and the male part is that which has a protrusion or nose, such that the protrusion or nose of the male part can be coupled in the cavity of the female part, regardless of whether it is a tooth or a tooth bar.

In view of the above, a female part according to the invention is a tooth or tooth bar for use in excavators and the like, with an internal cavity and with at least two opposite walls, each with an outer surface and an inner surface coinciding with the cavity, at least one of said walls having at least a through orifice and a retaining device formed by at least one tightening element, such that the retaining device is auto-fixed directly by pressure against at least one inner surface of at least one wall with an orifice, said element interfering with said at least one orifice.

On the contrary, a male part according to the invention, is a tooth or tooth bar for use in excavators and the like, with a protrusion or nose with at least two opposite or side outer surfaces, at least one of said surfaces having an orifice giving access to a duct which preferably crosses said nose and which incorporates a retaining device formed by at least one tightening element, such that the retaining device is auto-fixed directly by pressure at least against the two outer surfaces, said element interfering with said at least one orifice giving access to the duct crossing said nose.

The combination of a female part and a male part, in conjunction with a pin and a retaining device results in a retaining system for coupling two mechanical parts to one another, preferably for use in excavators and the like, in which the retaining device interferes with an introduction orifice for introducing the pin and is auto-fixed by pressure and in direct contact against one of the two parts, such that the rotation of the pin causes the coupling between both parts to go from a retaining position in which the retaining device is fitted into at least one notch of the in preventing both parts from separating, to a release position in which the retaining device comes out of said at least one notch pushed by the pin when it rotates and allowing the extraction of the pin and the separation of both parts.

The invention claimed is:

1. A female part of the type used in excavators, comprising an internal cavity and with at least two opposite walls, each with an outer surface and an inner surface coinciding with the cavity and at least one of said walls having a through orifice, and a retaining device formed by at least one tightening element, wherein the retaining device comprises two straight sectors attached to one another at one end of each straight sector by a third sector, having a shape conforming to the cavity so as to directly auto-fix by pressure the two straight sectors against the inner surfaces of the walls, and at least one of said straight sectors interfering with an opening of the orifice.

2. The part according to claim 1, wherein at least one inner surface of the wall has a groove to house the retaining device.

3. The part according to claim 2, wherein the groove runs along at least the inner surface of a wall.

4. The part according to claim 3, wherein the groove runs along the inner surfaces of the least two opposite walls of the cavity and of a bottom of said cavity.

* * * * *